US007228766B1

(12) United States Patent
Shyu

(10) Patent No.: US 7,228,766 B1
(45) Date of Patent: Jun. 12, 2007

(54) DETACHABLE CROSS WRENCH

(76) Inventor: Jun-Tsai Shyu, 8F, No. 68, Yu-Shyan Rd., Taiping (TW) 411

( * ) Notice: Subject to any disclaimer, the term of this patent is extended or adjusted under 35 U.S.C. 154(b) by 0 days.

(21) Appl. No.: 11/410,876

(22) Filed: Apr. 26, 2006

(51) Int. Cl.
*B25B 23/16* (2006.01)
*B25G 1/00* (2006.01)

(52) U.S. Cl. ..... 81/177.1; 81/177.5; 81/177.85; 81/125.1

(58) Field of Classification Search ..... 81/177.1, 81/177.5, 177.85, 125.1
See application file for complete search history.

(56) References Cited

U.S. PATENT DOCUMENTS 2,968,980 A * 1/1961 Zierold ..... 81/177.5
5,685,207 A * 11/1997 Hubert ..... 81/177.5
6,260,452 B1 * 7/2001 Yu ..... 81/177.2
7,040,200 B2 * 5/2006 Lin ..... 81/177.5

* cited by examiner

*Primary Examiner*—Joseph J. Hail, III
*Assistant Examiner*—Shantese McDonald
(74) *Attorney, Agent, or Firm*—Troxell Law Office, PLLC

(57) ABSTRACT

A detachable cross wrench includes a primary bar and a secondary bar. The primary bar has a thickening middle portion being formed at the center thereof. A turning handle is mounted on the other end of the primary bar. A lateral through hole is formed in the thickening middle portion for insertion of a secondary bar to create a cross type wrench. A longitudinal hole communicates the lateral through hole for receiving compression knob in cooperation with a resilient element and a positioning element. The compression knob has a slim portion in the middle thereof and an engaging portion at the lower portion thereof. Based on the above-mentioned configuration, the primary bar and the secondary bar can be easily and optionally engaged in place into one of the engaging grooves in the secondary bar for fulfilling the practical and safety requirements.

1 Claim, 3 Drawing Sheets

DETACHABLE CROSS WRENCH

BACKGROUND OF THE INVENTION

1. Fields of the Invention

The invention relates to a detachable cross wrench, and more particularly to a detachable cross wrench that allows an easy assembly and a practical disassembly. Meanwhile, a sufficient engaging force is existing to avoid an unexpected slipping in application of force. Accordingly, the safety in use can be ensured.

2. Description of the Related Art

As well known, the cross wrench is primarily applied to loosen larger screw elements on the car wheels. Therefore, the cross wrench has a longer arm of force for both hands of the operator to exert force, thereby achieving a greater torque. Most of these conventional products (not shown) have a fixed type structure. Thus, they occupy a large space when packed, transported, and carried. This results in packing, transporting and carrying inconvenience as well.

In order to improve the fixed type structure, a foldable cross wrench (not shown) has been developed. Although this improvement can remove the drawback of occupying large space, the structural strength is considerably affected. In other words, the joints of the conventional product can be easily broken or bent due to application of a too great force. Even, an undesired slipping can arise during the application of force and leads to an undesired folding action. This may cause inconvenience in operation. In a serious case, the operator may be injured. Thus, the conventional cross wrench requires further improvement.

SUMMARY OF THE INVENTION

Therefore, a primary object of the invention is to provide a detachable cross wrench that increases the strength of the whole structure and enhances the connection between a primary bar and a secondary bar. Thus, a convenient, practical and safe requirement can be ensured.

According to the invention, a detachable cross wrench includes a primary bar and a secondary bar. A lateral through hole is formed in the thickening middle portion for insertion of a secondary bar to create a cross type wrench. A longitudinal hole communicates the lateral through hole for receiving compression knob in cooperation with a resilient element and a positioning element. The compression knob has a slim portion in the middle thereof and an engaging portion at the lower portion thereof. Based on the above-mentioned configuration, the primary bar and the secondary bar can be easily and optionally engaged in place into one of the engaging grooves in the secondary bar for fulfilling the practical and safety requirements.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
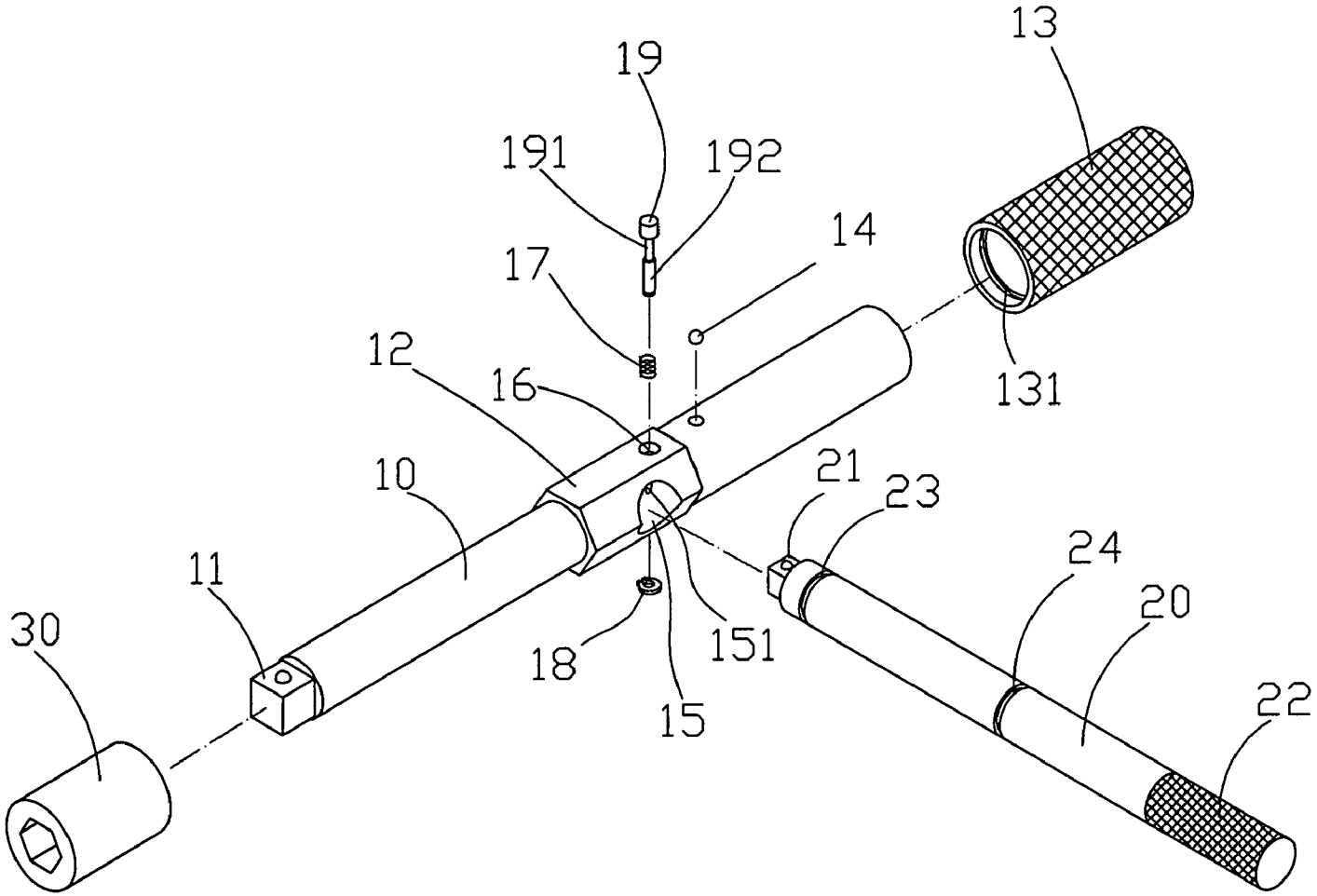
FIG. 1 is a perspective exploded view of the invention.
Figure 2:
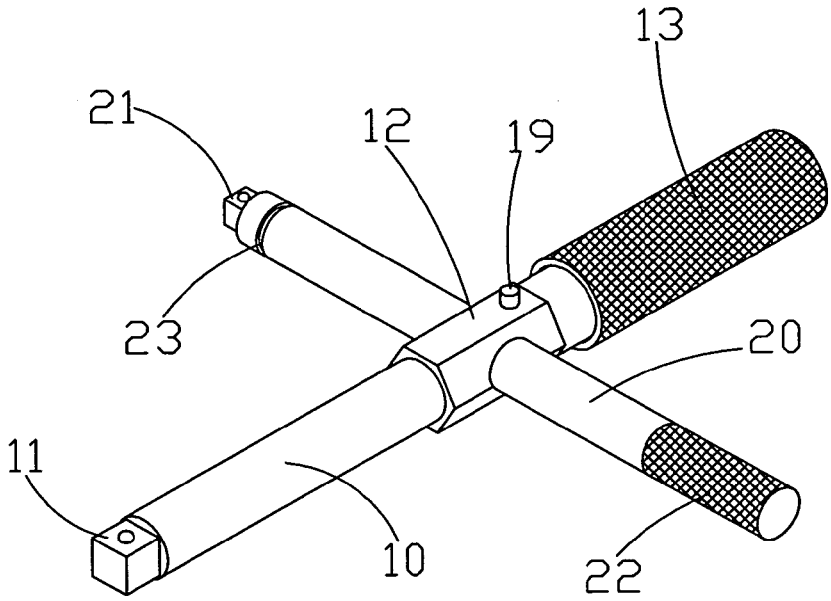
FIG. 2 is a perspective view of the invention in assembled state.
Figure 3:
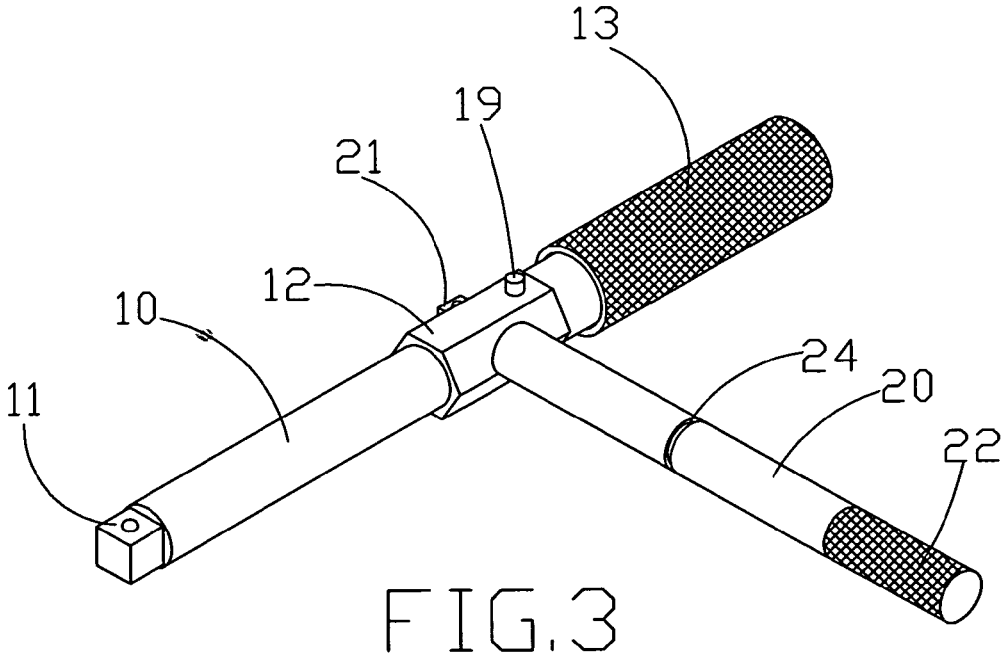
FIG. 3 is a perspective view of the invention in another assembled state.

First of all, referring to FIGS. 1 through 3, a detachable cross wrench in accordance with the invention is includes:

a primary bar 10 having one polygonal portion 11 at one end thereof for receiving a socket 30, a thickening middle portion 12 being formed at the center thereof for increasing the structural strength, a turning handle 13 being mounted on the other end of the primary bar 10, a positioning ball 14 being received within an annular slot so that the turning handle 13 is pivotally disposed, a lateral through hole 15 being formed in the thickening middle portion 12 for insertion of an secondary bar 20 to create a cross type wrench, a longitudinal hole 16 communicating the lateral through hole 15 for receiving compression knob 19 in cooperation with a resilient element 17 and a positioning element 18, the compression knob 19 having a slim portion 191 in the middle thereof and an engaging portion 192 at the lower portion thereof; and a secondary bar 20 having a polygonal portion 21 at one end thereof for receiving a socket 30 and a handle portion 22 at the other end thereof, the secondary bar 20 further having a first engaging groove 23 and a second engaging groove 24.

Based on the above-mentioned configuration, the primary bar 10 and the secondary bar 20 can be easily and optionally engaged in place for achieving the desired effect.

Figure 4:
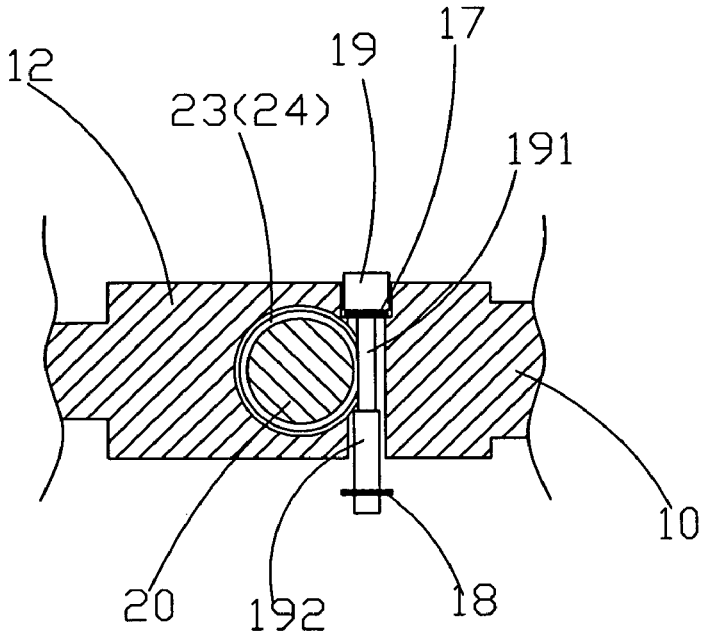
FIG. 4 is a partially sectional view of the invention in a released state.
Figure 5:
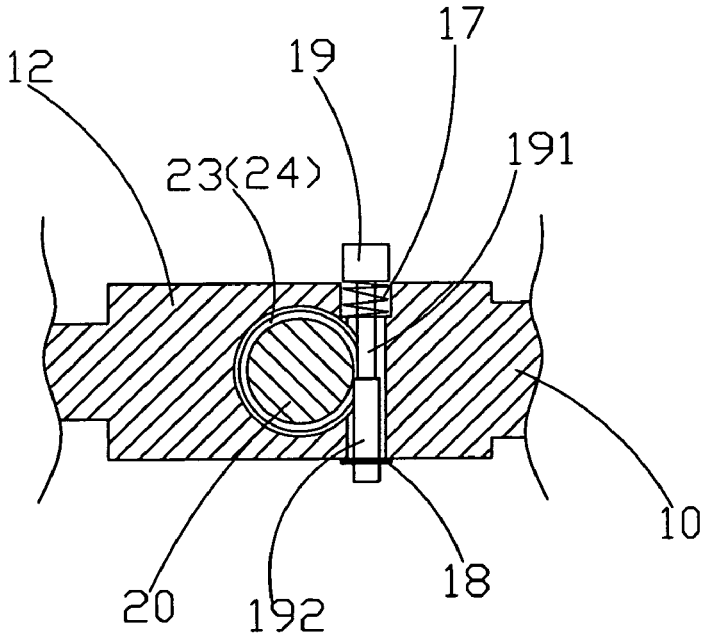
FIG. 5 is a partially sectional view of the invention in an engaged state.

As shown in FIGS. 4 and 5, the operator has to compress the compression knob 19 in inserting or releasing the secondary bar 20. In this way, the slim portion 191 of the compression knob 19 is located at a connection portion 151 between the lateral through hole 15 and the longitudinal hole 16. Accordingly, the secondary bar 20 is freely movable within the lateral through hole 15. When the compression knob 19 is released, the engaging portion 192 of the compression knob 19 is extended under the influence of the resilient element 17 into the connection portion 151 of the lateral through hole 15. Meanwhile, the engaging portion 192 is engaged into the first engaging groove 23 or the second engaging groove 24 in position.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A detachable cross wrench, comprising:

a) a primary bar having one polygonal portion at one end thereof, a thickening middle portion being formed at the center thereof, a turning handle being mounted on the other end of the primary bar, a lateral through hole being formed in the thickening middle portion for insertion of a secondary bar to create a cross type wrench, a longitudinal hole communicating with the lateral through hole for receiving a compression knob in cooperation with a resilient element and a positioning element, the compression knob having a slim portion in the middle thereof and an engaging portion at the lower portion thereof; and a secondary bar having a polygonal portion at one end thereof and a handle portion at the other end thereof, the secondary bar further have at least one engaging groove, whereby the primary bar and the secondary bar are easily fixed in relation to one another through the engaging portion selectively engaging the engaging grooves in the secondary bar.

* * * * *